United States Patent [19]

Hill et al.

[11] Patent Number: 4,601,638

[45] Date of Patent: Jul. 22, 1986

[54] AIRFOIL TRAILING EDGE COOLING ARRANGEMENT

[75] Inventors: Edward C. Hill, Tequesta; George P. Liang, Palm City; Thomas Auxier, Lake Park, all of Fla.

[73] Assignee: United Technologies Corporation, Hartford, Conn.

[21] Appl. No.: 685,263

[22] Filed: Dec. 21, 1984

[51] Int. Cl.[4] ..... F01D 5/18

[52] U.S. Cl. ..... 416/97 R; 415/115

[58] Field of Search ..... 416/97 R, 97 A, 90 R, 416/95, 96 R, 96 A, 91; 415/115; 60/39.83

[56] References Cited

U.S. PATENT DOCUMENTS

| | | | |
|---|---|---|---|
| 3,420,502 | 1/1969 | Howald | 416/97 R |
| 3,799,696 | 3/1974 | Redman | 415/115 |
| 3,844,678 | 10/1974 | Sterman et al. | 415/115 |
| 3,864,058 | 2/1975 | Womack | 416/97 R |
| 3,885,609 | 5/1975 | Frei et al. | 416/97 R |
| 3,930,748 | 1/1976 | Redman et al. | 416/97 A |
| 4,128,928 | 12/1978 | Shotts | 29/156.8 B |
| 4,229,140 | 10/1980 | Scott | 416/97 R |
| 4,236,870 | 12/1980 | Hucul, Jr. et al. | 415/115 |
| 4,286,924 | 9/1981 | Gale | 415/115 |
| 4,303,374 | 12/1981 | Braddy | 416/97 R |
| 4,461,612 | 7/1984 | Dodd | 416/97 R |

FOREIGN PATENT DOCUMENTS

| | | |
|---|---|---|
| 1601613 | 12/1970 | Fed. Rep. of Germany . |
| 2227913 | 11/1974 | France . |

*Primary Examiner*—Robert E. Garrett
*Assistant Examiner*—H. Edward Li
*Attorney, Agent, or Firm*—Stephen E. Revis

[57] ABSTRACT

A turbine airfoil for high temperature applications has a spanwise trailing edge slot and a cut back pressure side wall. The pressure side wall has a thickness t at its downstream end. The slot is divided into channels which discharge a film of cooling air over the exposed back surface of the suction side wall downstream of the cut back pressure side wall. Each channel tapers from a throat at its upstream end (which meters the flow of cooling air) to the slot outlet of width s. The airfoil is designed with a ratio t/s of no more than 0.7 which significantly improves cooling of the trailing edge, reduces required cooling air flow, and permits greater cut back distances.

8 Claims, 6 Drawing Figures

AIRFOIL TRAILING EDGE COOLING ARRANGEMENT

TECHNICAL FIELD

This invention relates to airfoils, and more particularly to cooling the trailing edge region of airfoils.

BACKGROUND ART

Airfoils constructed with spanwise cavities and passageways for carrying coolant fluid therethrough are well known in the art. Cooling fluid is brought into the cavities; and some of the fluid is ejected via holes in the airfoil walls to film cool the external surface of the airfoil. The trailing edge region of airfoils is generally difficult to cool because the cooling air is hotter when it arrives at the trailing edge since it has been used to cool other portions of the airfoil. The relative thinness of the trailing edge region makes it more susceptible to damage due to overheating and thermal stresses.

In U.S. Pat. No. 4,303,374 the pressure side wall of the airfoil terminates short of the trailing edge formed by the suction side wall (i.e. the pressure side wall is "cut back") thereby exposing the inside surface of the suction side wall in the trailing edge region to the hot gases passing around the airfoil. A spanwise slot in the trailing edge region discharges cooling fluid from a central cavity over the exposed inside surface of the suction side wall. Disposed within the trailing edge slot are a plurality of partitions which are spaced apart in the spanwise direction defining transverse cooling flow channels therebetween within the trailing edge slot. Each partition has an upstream portion with straight, parallel side walls, and a downstream portion which tapers to substantially a point at the outlet of the slot. The transverse channels, therefore, include a straight upstream portion and a diffusing downstream portion. The object is to form a continuous sheet of cooling air which remains attached to the exposed inside surface of the suction side wall downstream of the slot outlet. Other patents showing spanwise trailing edge region slots and cut back pressure side walls are U.S. Pat. Nos. 3,885,609; 3,930,748; and 4,229,140.

It is also known to provide straight (as opposed to tapered) ribs along the exposed inside surface of the suction side wall downstream of the trailing edge slot for carrying cooling fluid from the slot across that exposed portion.

In the art of cooling turbine blades of gas turbine engines, it is important to minimize the amount of coolant flow required to cool the blades, because that cooling air is working fluid which has been bled from the compressor, and its loss from the gas flow path reduces engine efficiency. It is also desirable to cut back the pressure side wall of turbine airfoils to improve airfoil aerodynamics; however, this results in a trailing edge region which is likely to be too thin to accommodate an internal cavity with conventional film cooling holes extending outwardly therefrom. Instead, spanwise trailing edge region slots and cut back pressure side walls have been used in place of conventional film cooling holes, such as shown in hereinbefore discussed U.S. Pat. No. 4,303,374.

In airfoils with thin trailing edge regions, the cut back portion of the trailing edge is film cooled by cooling air exiting from a slot within the trailing edge region. The cooling air exiting the slot forms a film on the exposed internal surface of the suction side wall downstream of the slot. To be effective, decay of the film as it moves further downstream from the slot outlet must be minimized to the extent that the film is still sufficiently effective at the trailing edge. In this specification and appended claims, the distance between the cut back downstream edge of the pressure side wall and the trailing edge of the airfoil as defined by the suction side wall downstream end is the "cut back distance" x. The longer the cut back distance x the more difficult it is to maintain film cooling effectiveness over the full length of the cut back.

Despite the variety of trailing edge region cooling configurations described in the prior art, further improvement is always desireable in order to allow the use of higher operating temperatures, less exotic materials, and reduced cooling air flow rates through the airfoils, as well as to minimize manufacturing costs, such as by being able to cast the entire airfoil, including all cooling air channels. Presently in high temperature blades, the channels within the trailing edge slot are very thin and are machined, such as by electro discharge machining, using thin, rod-like electrodes. Casting requires larger passageways, which can result in the airfoil becoming too thin in the trailing edge. Also, wider channels may flow too much cooling fluid if incorporated into airfoils in a conventional manner.

DISCLOSURE OF INVENTION

One object of the present invention is an improved trailing edge region cooling configuration for a turbine blade airfoil.

Another object of the present invention is a turbine blade airfoil having a trailing edge region cooling configuration wherein a lower coolant flow rate can provide cooling equivalent to the cooling provided by higher flow rates of the prior art.

A further object of the present invention is a turbine blade airfoil trailing edge region cooling configuration which may be cast.

Yet another object of the present invention is a turbine blade airfoil with increased pressure side cut back length in the trailing edge region.

According to the present invention, an airfoil has a spanwise cooling air cavity and a spanwise trailing edge slot in fluid communication with the cavity, the slot outlet being disposed at the cut back downstream edge of the pressure side wall, the edge having a thickness t, wherein downstream extending partitions disposed within the slot and extending downstream thereof divide the slot into a plurality of channels, each channel having a width s at the slot outlet, the channels discharging cooling air over the exposed back surface of the suction sidewall, each channel having a throat upstream of the slot outlet, and wherein the ratio t/s is less than or equal to 0.7.

P is a dimensionless air flow parameter directly proportional to the cut back distance and inversely proportional to the cooling air flow rate. Higher values of P mean greater cut back distances and less air flow for equivalent film cooling effectiveness. Film cooling effectiveness is the difference between the main gas stream temperature and the temperature of the coolant film, divided by the difference between the main gas stream temperature and the coolant temperature at the slot exit.

It has been discovered that high film cooling effectiveness can be maintained over significantly longer cut back distances using significantly less cooling air when the ratio t/s is low (preferably less than 0.7, most preferably less than 0.6). More specifically, a prior art airfoil having a t/s ratio of 1.2 has a value of P only one fifth the value for an airfoil having a t/s ratio of 0.7, at the same level of film cooling effectiveness.

For very high temperature applications, such as for gas stream temperatures surrounding the airfoil greater than about 2300° F., most prior art blades use 40% or more of the total cooling air brought into the blade (i.e. the blade cooling air supply) for cooling the trailing edge region. With the present invention it is possible to cool the trailing edge region of turbine blade airfoils operating in 2300°-2600° F. (and higher) gas stream temperatures utilizing 30% or less of the blade cooling air supply.

The present invention is particularly useful for airfoils with thin trailing edges (i.e. 40 mils thick, or less). Cooling problems increase as the trailing edge thickness is reduced. In the prior art it was felt that cut back distances could not be further increased and trailing edge thickness could not be further reduced because cooling flow rates would have to be increased excessively to assure adequate cooling of the full length of the cut back portion. The discovery, by the present inventors, of the surprising benefit provided by a smaller t/s ratio changes this way of thinking. The cooling improvements provided by t/s ratios of 0.7 and less not only allow longer cut backs (for improved aerodynamics performance), but reduce the coolant flow requirements to cool the longer cut back portion of the trailing edge region. Furthermore, increasing the cut back distance not only provides greater airfoil thickness at the trailing edge slot outlet (thereby allowing the t/s ratio to be decreased), it results in reduced gas stream pressure at the slot outlet such that larger slots can be used without increasing and preferably, decreasing the coolant flow rate. Larger slots are easier to fabricate and, if large enough, may be castable.

In accordance with one aspect of the present invention the air flow through each channel within the slot is metered upstream of the slot outlet. The dimension s at the slot outlet may then be increased to the extent permitted by the thickness of the airfoil at that location to reduce the t/s ratio without increasing coolant flow rate.

For lack of realizing that there are dramatic cooling improvements for low ratios of t/s, the cut back distance for prior art airfoils operating in gas path temperatures above about 2300° F. has been maintained well below 100 mils. The present invention permits cutbacks of at least 100 mils in such environments, and with reduced coolant flow. Furthermore, the trailing edge thickness of airfoils constructed in accordance with the teachings of the present invention may be made as small as 35 mils or less. This improves airfoil aerodynamics, and can be accomplished only because the cut back distance can be increased, thereby providing additional material thickness at the slot outlet (where s is measured). This allows the value of s to be increased so the airfoil may be constructed with a t/s ratio of 0.7 or less. Short cut back distances used in the prior art at these high gas temperatures meant reduced airfoil thickness at the slot outlet and the requirement for a thicker trailing edge region and trailing edge to compensate.

The foregoing and other objects, features and advantages of the present invention will become more apparent in the light of the following detailed description of preferred embodiments thereof as shown in the accompanying drawing.

BEST MODE FOR CARRYING OUT THE INVENTION

Figure 6:
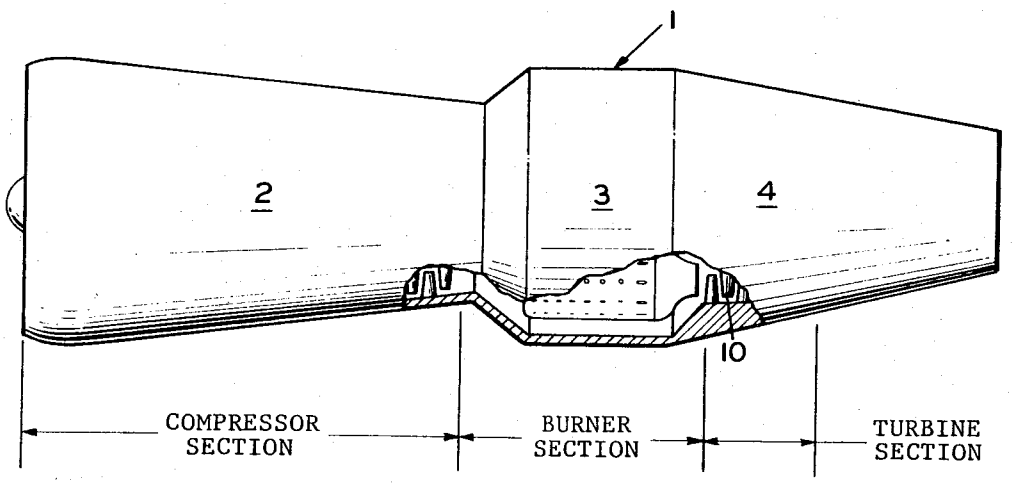
FIG. 6 is a schematic representation of a gas turbine engine.

Referring to FIG. 6, a gas turbine engine is shown indicated generally by the numeral 1. The engine comprises, in series, a compressor section 2, a burner section 3, and an axial flow turbine section 4 for receiving combustion gases from the burner section. The turbine section includes at least one stage of turbine blades 10.

Figure 1:
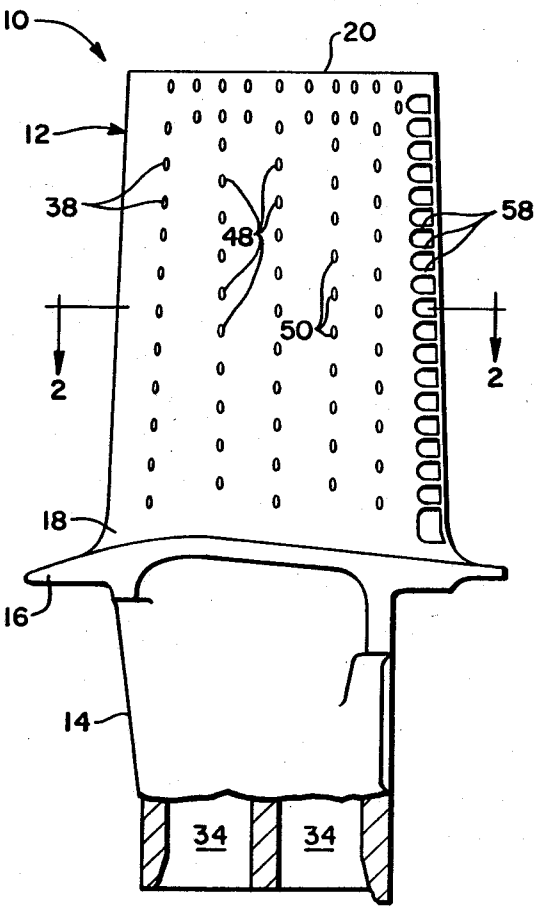
FIG. 1 is a side elevation view, partly broken away, of a gas turbine engine turbine blade according to the present invention.

As an exemplary embodiment of the present invention consider the gas turbine engine turbine blade of FIG. 1. As shown in FIG. 1, the blade 10 includes an airfoil 12, a root 14, and a platform 16. The airfoil 12 has a base 18 and a tip 20. In this specification and appended claims, the spanwise or longitudinal direction is in the direction of the length of the airfoil, which is from its base 18 to its tip 20. In this exemplary embodiment the airfoil is a single piece casting. Although the invention is particularly advantageous for hollow, one piece cast blades, it is not intended to be limited thereto.

Figure 2:
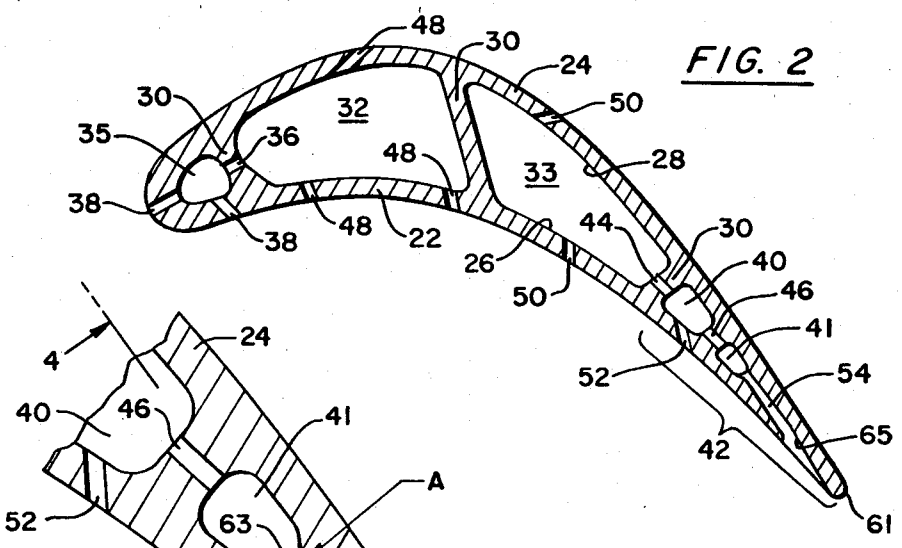
FIG. 2 is an enlarged cross-sectional view taken generally along the line 2—2 of FIG. 1.
Figure 3:
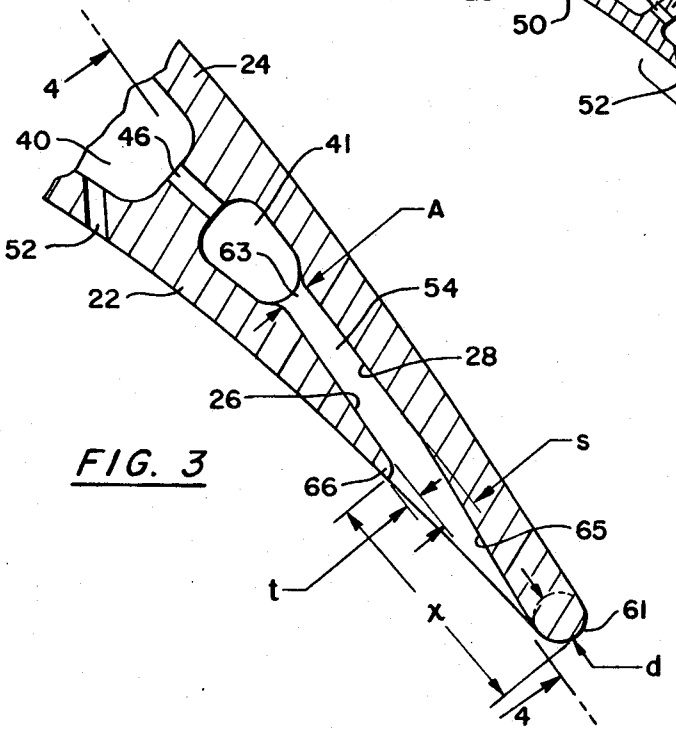
FIG. 3 is an enlarged view of the trailing edge region shown in FIG. 2.

As best shown in FIGS. 2 and 3, the airfoil 12 includes a pressure side wall 22 and a suction side wall 24. The inside wall surfaces 26, 28 of the pressure and suction side walls 22, 24, respectively, along with the spanwise partitions 30 extending between them define spanwise central cooling air passageways 32, 33 which extend substantially the full length of the airfoil 12. The cavities 32, 33 are fed cooling air via a pair of channels 34 (FIG. 1) extending longitudinally through the root 14 and in communication with the cavities. The cavity 32 feeds a spanwise extending leading edge cavity 35 via a plurality of interconnecting passages 36. Cooling air from the leading edge cavity 35 exits the airfoil via a plurality of holes 38 to provide convective and film cooling of the airfoil leading edge. The remainder of the cooling air from the cavity 32 exits the airfoil via a plurality of passages 48 and film cools the walls 22, 24. The central cavity 33 communicates with two additional spanwise extending cavities 40, 41 in the trailing edge region 42 of the airfoil via a plurality of interconnecting passages 44, 46. A portion of the air from the cavity 33 exits the airfoil and film cools the outer surfaces thereof via passages 50. The remainder enters the cavity 40 via the interconnecting passages 44, some of which exits the airfoil via passages 52, the remainder flowing into the cavity 41. Cooling air from the cavity 41 passes from the airfoil via a spanwise extending slot 54 defined between the pressure and suction side wall internal surfaces 26, 28, respectively.

Figure 4:
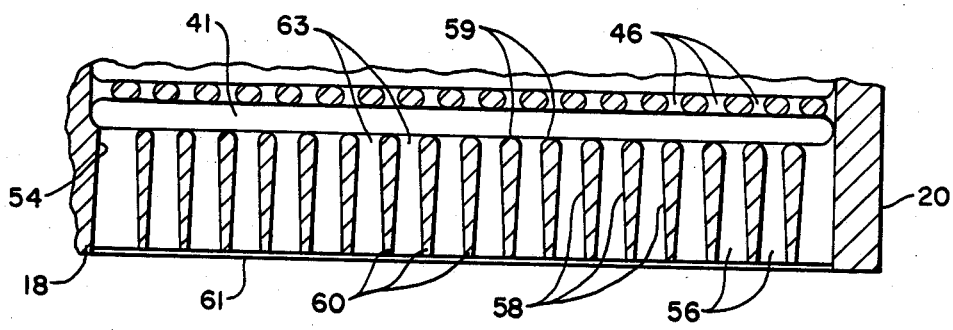
FIG. 4 is a view taken generally along the line 4—4 of FIG. 3.

As best shown in FIG. 4, the slot 54 is divided into a plurality of downstream extending channels 56 by means of a plurality of spanwise spaced apart, downstream extending partitions 58. The upstream end 59 of each partition 58 is rounded to minimize turbulence. Each partition extends from the cavity 41 and tapers in a downstream direction to its downstream most end 60 at the trailing edge 61 of the airfoil 12. The channels 56 thus diffuse in a spanwise direction from a throat 63 at their upstream ends, to their downstream ends at the trailing edge 61. The coolant flow rate through each channel 56 is metered at the throat 63. As best shown in FIG. 3, the pressure side wall 22 is cut back a distance x from the trailing edge 61 such that the trailing edge is defined solely by the downstream most end of the suction side wall 24. The cut back exposes the portion 65 of the inside or back surface 28 of the suction side wall 24, downstream of the pressure side wall end 66, to the hot gases in the engine flow path.

In this embodiment the trailing edge 61 has a diameter d. Thus, the thickness of the trailing edge is d. The thickness t of the downstream edge 66 of the pressure side wall 22, which is at the outlet of the trailing edge slot 54, is preferably as small as possible. A practical state of the art as-cast minimum for t is about 0.010 inch. A throat width A as small as 0.014 inch can be made with state of the art casting technology. Throat width A is measured in a plane perpendicular to the spanwise direction. The slot outlet width s is measured perpendicular to the slot suction side wall 28, also in a plane perpendicular to the spanwise direction and is the distance from that internal suction side wall to the internal pressure side wall 26 at the slot outlet.

Figure 5:
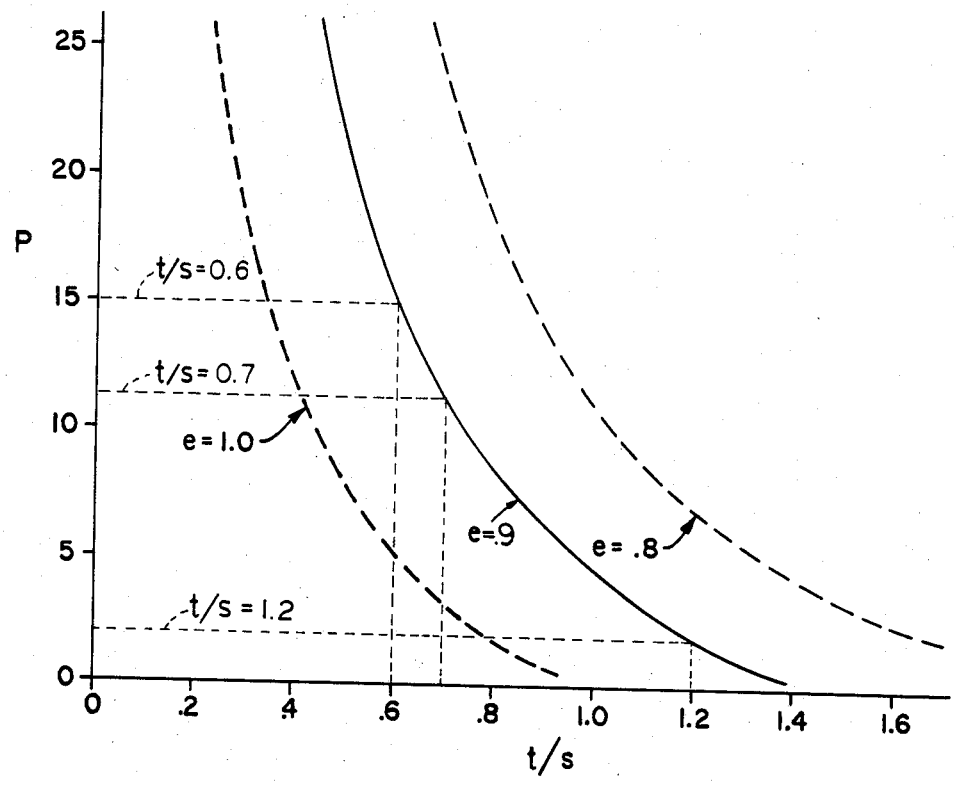
FIG. 5 is a graph showing the relationship of the ratio t/s to a dimensionless coolant flow parameter P for various values of film cooling effectiveness.

In the graph of FIG. 5 the ratio t/s is plotted against P a dimensionless flow parameter, which is directly proportional to the cut back distance x. P is plotted against t/s for several values of e, the film cooling effectiveness. The graph shows that the value of e can remain constant as x increases, if the value of the ratio t/s is decreased. For example, for a film cooling effectiveness of 0.9, a reduction in the value of t/s from 1.2 (prior art) to 0.7, results in an increase in P of from about 2 to 10. This means that if all other parameters affecting P could be held constant, the cut back distance x could be increased by a factor of 5 without a loss of film cooling effectiveness over the length of the cut back portion. Alternately, or in combination, the coolant flow rate could be reduced and the cut back distance increased, some lesser amount. For airfoils operating in 2300° F. gas streams, and with trailing edge thicknesses d of under 0.04 inch, cut back distances of at least 100 mills, preferably 130 mils, and most preferably greater than 200 mils can be used while decreasing the amount of coolant needed to cool the trailing edge to 30% or less of the total blade coolant supply.

The magnitude of s is limited by the minimum permissible thickness of the suction side wall 24 at the slot outlet. As can be seen in FIG. 3, the suction side wall is thinnest at the slot outlet, and then increases to a thickness d at the trailing edge 61. Since the slot throat at 63 is used to meter the flow through the slot, the dimension s will be greater than dimension A. The greater the distance x the thicker the airfoil at the slot outlet. This, in turn, permits fabricating the airfoil with a larger slot outlet dimension s. To maximize the benefits of the present invention, t is made as small as possible consistent with strength requirements, and s is made as large as possible, also consistent with strength requirements, such that t/s is no greater than 0.7. Thus, the channels 56 diffuse from their throat 63 to the slot outlet when viewed in a cross section perpendicular to the spanwise direction. This diffusion in and of itself improves cooling capabilities of the present invention and is highly desirable.

A turbine airfoil made in accordance with the teachings of the present invention and which operated successfully in a gas stream having a temperature of about 2600° F. had the following approximate dimensions:

airfoil length (base to tip): 1.8 inches
mid span chord length: 1.3 inches
distance from slot throat to slot outlet: 0.140 inches
A=0.018 in.
s=0.022 in.
t=0.010 in.
x=0.140 in.
d=0.030 in.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. An airfoil including a pressure side wall having a spanwise extending downstream edge of thickness t, and a suction side wall, said suction side wall defining the trailing edge of said airfoil, said trailing edge having a thickness d, a spanwise cooling air cavity defined between said pressure and suction side walls, said airfoil including a trailing edge region downstream of said cavity, said downstream edge of said pressure side wall being spaced a distance x upstream of said trailing edge exposing a back surface of said suction side wall downstream thereof, said pressure and suction side walls spaced apart defining a spanwise extending slot therebetween in said trailing edge region in fluid communication with said cavity, a plurality of longitudinally spaced apart, downstream extending partitions disposed within said slot and dividing said slot into a plurality of channels, each channel having an inlet for receiving cooling air from said cavity and an outlet of width s, measured in a plane perpendicular to the spanwise direction, at said pressure side wall downstream edge for discharging cooling air from said airfoil, each channel having a throat at its inlet of width A, measured in a plane perpendicular to the spanwise direction, A being less than s, wherein the ratio t/s is less than or equal to 0.7, x is at least 0.100 inch, d is no greater than 0.040 inch, and the thickness of the suction side wall at the channel outlets is less than the thickness d of the trailing edge.

2. The airfoil according to claim 1 wherein t/s is less than or equal to 0.60, d is no greater than 0.035 inch, and x is at least 0.130 inch.

3. The airfoil according to claim 2 wherein t is about 0.010 inch, and d is no greater than 0.030 inch.

4. The airfoil according to claim 1 wherein said partitions extend substantially to said trailing edge, and the thickness of each of said partitions decreases from a point upstream of said channel outlets to said trailing edge, whereby said channels diffuse in the downstream direction, as viewed in a longitudinal plane through said slot.

5. In a gas turbine engine having, in series, a compressor section, a burner section, and an axial flow turbine section for receiving combustion gases from said burner section, said turbine section including a stage of turbine blades, said blades each including a hollow airfoil having a radially extending cooling air cavity therewithin, said airfoil having a pressure side wall and suction side wall, a trailing edge region downstream of said cavity, and a radially extending cooling air slot within said trailing edge region, said suction side wall forming a trailing edge of thickness d of said airfoil, said pressure side wall having a spanwise extending downstream edge of thickness t spaced a distance x upstream of said airfoil trailing edge exposing a back surface of said suction side wall, said airfoil including a plurality of downstream extending partitions disposed within said slot defining a plurality of longitudinally spaced apart channels within said slot in fluid communication with said cavity for discharging a film of cooling air over said exposed back surface, each of said channels having an inlet of width A measured in a plane perpendicular to the spanwise direction, wherein the combustion gases in the vicinity of said trailing edge region are at least 2300° F., and the mass flow rate of cooling air passing into each of said hollow blades is M, the improvement comprising: wherein each of said channels has a throat defined by said inlet, each channel diffusing in the downstream direction, as viewed in cross section perpendicular to the spanwise direction, from its throat to its outlet of width s at said pressure side wall downstream edge, s being greater than A, t/s is no greater than 0.7, d is no greater than 0.040 inch, x is at least 0.100 inch, and said airfoil is constructed such that no more than 35% of M is discharged from said airfoil through said channels of said airfoil.

6. The gas turbine engine according to claim 5 wherein the combustion gases in the vicinity of said trailing edge region are at least 2600° F., t/s is no greater than 0.60, d is no greater than 0.03 inch, x is at least 0.130 inch, and said airfoil is constructed such that no more than 30% of M is discharged from said airfoil through said channels of said airfoil.

7. The gas turbine engine according to claim 5 wherein said partitions extend substantially to said trailing edge and decrease in thickness, as viewed in a longitudinal plane through said slot, from a point upstream of said channel outlets to said trailing edge.

8. The gas turbine engine according to claim 5 wherein the thickness of the suction side wall at the channel outlets is less than the thickness d of the trailing edge.

* * * * *

UNITED STATES PATENT AND TRADEMARK OFFICE

CERTIFICATE OF CORRECTION

PATENT NO. : 4,601,638

DATED : July 22, 1986

INVENTOR(S) : Edward C. Hill et al

It is certified that error appears in the above-identified patent and that said Letters Patent is hereby corrected as shown below:

Column 1, After Title but before Technical Field insert the following paragraph:

-- The Government has rights in this invention pursuant to contract number F33657-82-C-0122 awarded by the Department of the Air Force. --

Signed and Sealed this

Seventh Day of April, 1987

*Attest:*

DONALD J. QUIGG

*Attesting Officer*

*Commissioner of Patents and Trademarks*